United States Patent [19]

Miranda

[11] 4,036,414

[45] July 19, 1977

[54] FABRIC CREASING MACHINE

[76] Inventor: Fernando Miranda, Aguadilla 57 Condado, San Juan, P.R.

[21] Appl. No.: 746,365

[22] Filed: Dec. 1, 1976

[51] Int. Cl.[2] ..... D06J 1/00

[52] U.S. Cl. ..... 223/28; 223/30; 223/32

[58] Field of Search ..... 223/28–35; 33/192; 93/60; 26/21

[56] References Cited

U.S. PATENT DOCUMENTS

| | | | |
|---|---|---|---|
| 2,689,070 | 9/1954 | Davis | 223/32 |
| 2,837,257 | 6/1958 | Gibson et al. | 223/30 |
| 3,726,448 | 4/1973 | Hales | 223/32 |

*Primary Examiner*—G. V. Larkin

*Attorney, Agent, or Firm*—Seidel, Gonda & Goldhammer

[57] ABSTRACT

A fabric creasing machine is disclosed for applying one or more creases in fabric. Only that portion of fabric to be creased is sucked by vacuum into the space between a pair of heated creasing bars by vacuum, and is subjected to steam while being pressed by the pressing bars.

10 Claims, 9 Drawing Figures

FABRIC CREASING MACHINE

BACKGROUND

Fabric is conventionally creased by placing the fabric in a folded condition on a bottom platen and then subjecting the fabric and the fold line to heat, steam and pressure from an upper platen. Since the entire fabric is subjected to high temperature, pressing is not done until after the fabric has been processed into the form of a garment or some other product. Pressing the garment or product before processing has not been adopted since subsequent processing will cause a change in dye shade and shrinkage. Dye shade usually occurs when the fabric is subjected to temperatures of approximately 400°F.

I have found that fabric can be creased immediately after being cut and prior to processing into the form of a garment or other product with a sharp crease that will become permanent even if the garment or product is washed and steam pressed.

SUMMARY OF THE INVENTION

The fabric creasing machine of the present invention includes at least one set of creasing bars wherein at least one of the creasing bars is supported for relative movement in a horizontal direction between open and closed positions so as to produce a gap therebetween in the open position of the creasing bars. A means is provided for moving at least one of the creasing bars between an open and closed position. A vacuum means is provided for causing a limited portion of a fabric to enter into a gap between the pressing bars. A means is provided for heating the pressing bars. And a means is provided for subjecting the limited portion of the fabric in a gap to superheated steam while the pressing bars are in a closed position.

In a preferred embodiment of the invention, a plurality of creases are simultaneously applied to a fabric. Only a small portion of the fabric disposed in the gap between creasing bars is subjected to heat, pressure, and steam whereby a permanent crease can be made even if the fabric is subsequently processed into a garment or other product and washed, steam pressed, etc.

It is an object of the present invention to provide a fabric creasing machine for applying at least one permanent crease in fabric.

It is another object of the present invention to provide a fabric creasing machine wherein heat, steam and pressure are applied only to the area of a fabric which is to be creased.

It is another object of the present invention to provide a fabric creasing machine and/or method whereby a plurality of creases may be simultaneously applied to narrow zones of a fabric.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown in FIG. 1 a fabric creasing machine in accordance with the present invention designated generally as 10.

Figure 1:
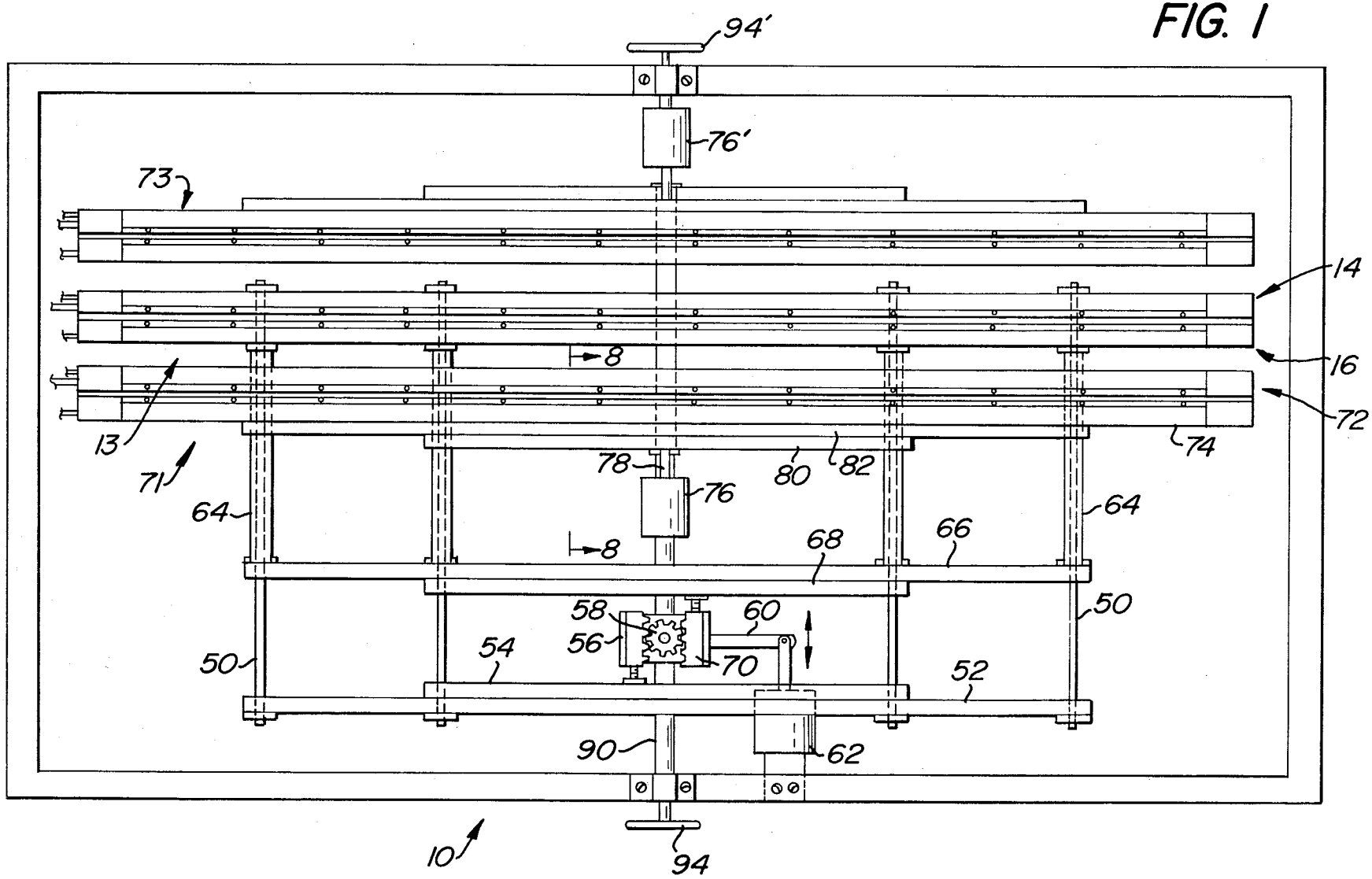
FIG. 1 is a top plan of a creasing machine in accordance with the present invention.

The machine 10 includes a frame 12. A first creasing unit 13 is supported by the frame 12 and includes creasing bars 14 and 16. See FIGS. 1 and 2. The creasing bars 14 and 16 are made of good heat conducting metal.

The creasing bars 14 and 16 are supported for relative movement in a horizontal direction between open and closed positions. When the creasing bars 14 and 16 are in an open position, a gap 18 exists between the bars adjacent the upper surface of the creasing bars. See FIG. 3.

A means is provided for limiting the effective depth of the gap 18. A preferred embodiment of the limiting means includes tapered pins 20 projecting horizontally from creasing bar 14 with mating holes 22 on the juxtaposed face of creasing bar 16. Each of the holes 22 slideably receives one of the pins 20.

A heating means, such as electrical heating elements 44, are placed in grooves of the creasing bars 14, 16. Temperature control bulbs 45 are embedded in grooves of creasing bars 14, 16 in order to control the temperature at which the bars 14, 16 are maintained by the heating elements 44. The heating elements 44 and control bulbs 45 are sealed within their grooves by cover plate 46 of creasing bar 14 and cover plate 47 of creasing bar 16.

A steam chamber 24 is provided between the juxtaposed faces of the creasing bars 14 and 16 immediately below the elevation of the pins 20. See FIG. 3. A steam conduit 26 extends longitudinally along one of the creasing bars 14, 16. As shown, the steam conduit 26 is associated with the creasing bar 14. Steam is transmitted to the chamber 24 from the conduit 26 by way of a plurality of holes 28 which are angled upwardly toward the gap 18.

The juxtaposed faces of the creasing bars 14 and 16 define a chamber 30 below and in direct communication with the steam chamber 24. The lower end of the chamber 30 is defined by a plate 32 on creasing bar 14 and a plate 34 on creasing bar 16. Plate 32 is provided with notches 36. Plate 34 is provided with notches 38. The notches 36 and 38 are staggered so that portions of the plates 32, 34 defining the bottom of the chamber 30 can telescope and guide horizontal movement of the creasing bars 14, 16 as they move between open and closed positions.

A vacuum chamber 40 communicates with the chamber 30 by way of the gap between a projection on plate 32 and a corresponding gap on plate 34, and a mating passageway in a base plate 49. See FIGS. 2 and 3. vacuum chamber 40 is provided with a conduit 42. A header 48 is provided at each end of the creasing bars 14, 16.

A flexible strip of material 122 is secured to the creasing bar 14. The material 122 is normally spaced from the cover plate 46 of the creasing bar 14. When a vacuum is applied to the vacuum chamber 40, the material 122 is flexed inwardly toward the gap 18. In this manner, the material 122 forms a seal by contacting cover plates 46, 47. In a similar manner, strips of material (not shown) are provided to seal the bottom and sides of the creasing bars 14, 16 whenever a vacuum is applied.

Figure 2:
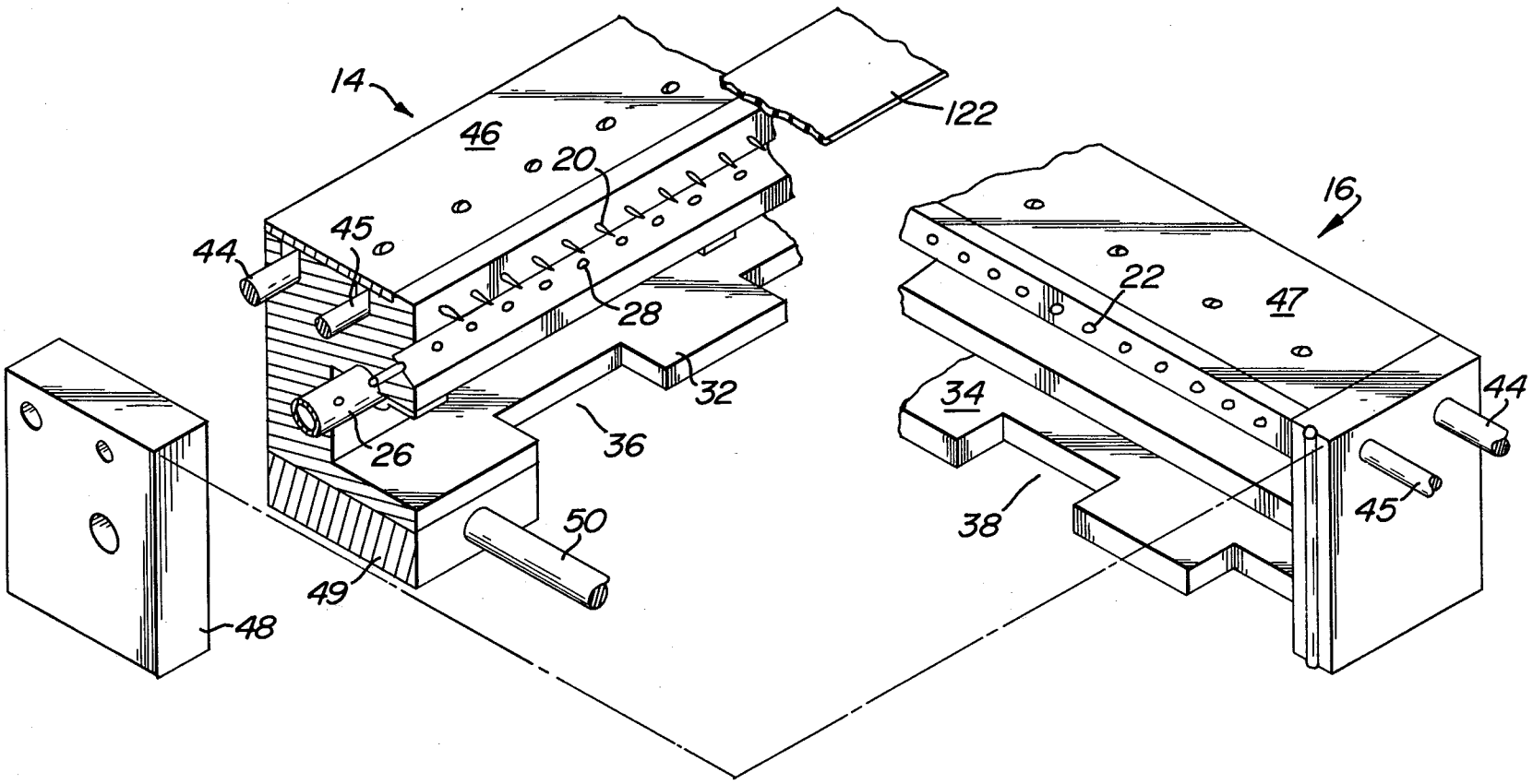
FIG. 2 is an exploded, partial perspective view of a set of creasing bars shown in FIG. 1.
Figure 3:
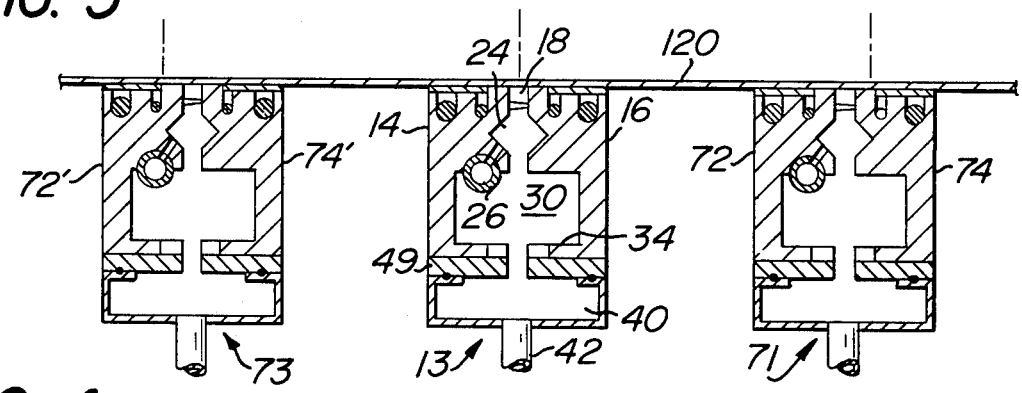
FIGS. 3–6 are sectional views diagrammatically illustrating the progressive application of a plurality of creases to a layer of fabric.
Figure 5:
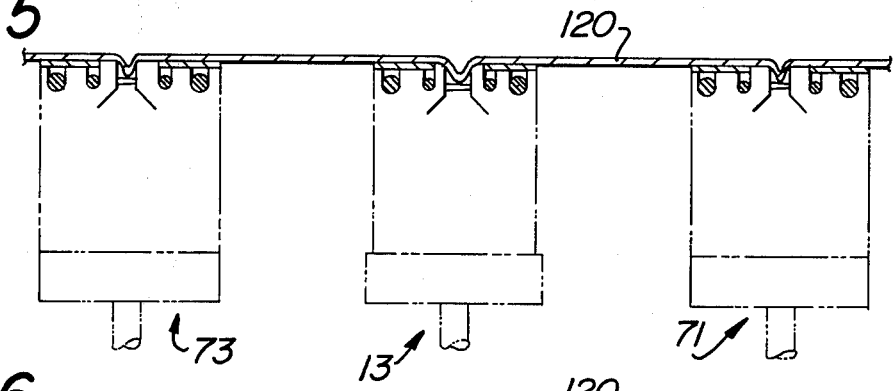
Figure 6:
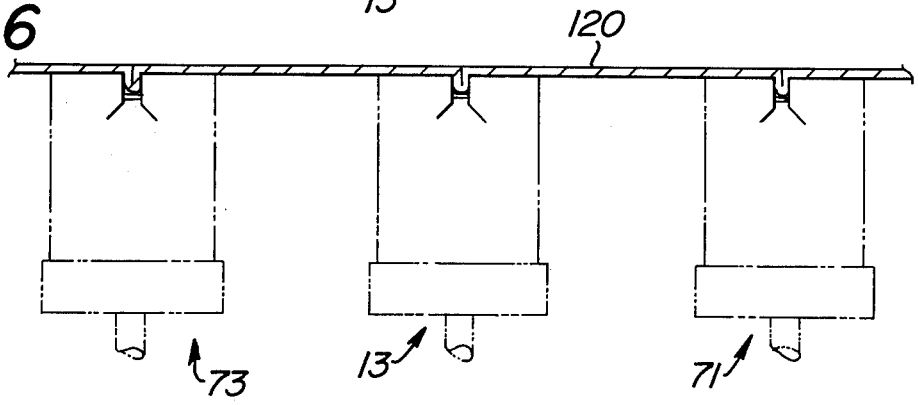

A means is provided to selectively move the creasing bars 14 and 16 between an open position as shown in FIG. 3 and a closed position as shown in FIGS. 5 and 6. Referring to FIG. 1, a pair of parallel rods 50 are coupled at one end to the creasing bar 14. The other ends of the rods 50 are interconnected by a connecting member 52. Connecting member 52 is connected to a pressing bar 54. Bar 54 is connected to a rack 56 meshed with a vertically disposed pinion 58.

The pinion 58 is rotatably supported for rotation about a vertical axis and is connected to one end of lever 60. Lever 60 is connected to the piston rod of an air cylinder 62 supported by the frame 12. Actuation of cylinder 62 rotates lever 60 which in turn rotates pinion 58.

A tube 64 is telescoped over each of the rods 50. One end of the tube 64 is secured to a side face of the creasing bar 16 with suitable insulation disposed therebetween. The other end of each tube 64 is connected to a connecting member 66. Connecting member 66 is secured to a pressing member 68. Pressing member 68 is connected to a second rack 70 which is also meshed with the pinion 58. Hence, as pinion 58 rotates, rack 56 moves in one horizontal direction while rack 70 moves in the opposite horizontal direction whereby the creasing bars 14 and 16 will move toward and away from each other in a horizontal direction.

The machine 10 may be provided with a second creasing unit designated generally as 71 which is parallel to or if desired slightly skewed with respect to the first creasing unit 13. The creasing unit 71 includes creasing bars 72 and 74.

If desired, a third creasing unit 73 may be provided parallel to or skewed from the first creasing unit 13 but on the opposite side from creasing unit 71. The provision of three creasing units, namely 13, 71 and 73 would be used, for example, in applying three parallel creases to the back of a shirt forming a part of a military uniform. Creasing unit 73 is identical with creasing unit 71 whereby corresponding primed numerals are applied to the drawing.

As will be made clear hereinafter, the creasing units move between an open and closed position in a sequential manner. One of the creasing bars of creasing units 71 and 73 is stationary except when the distance between adjacent creasing units is being adjusted.

Figure 8:
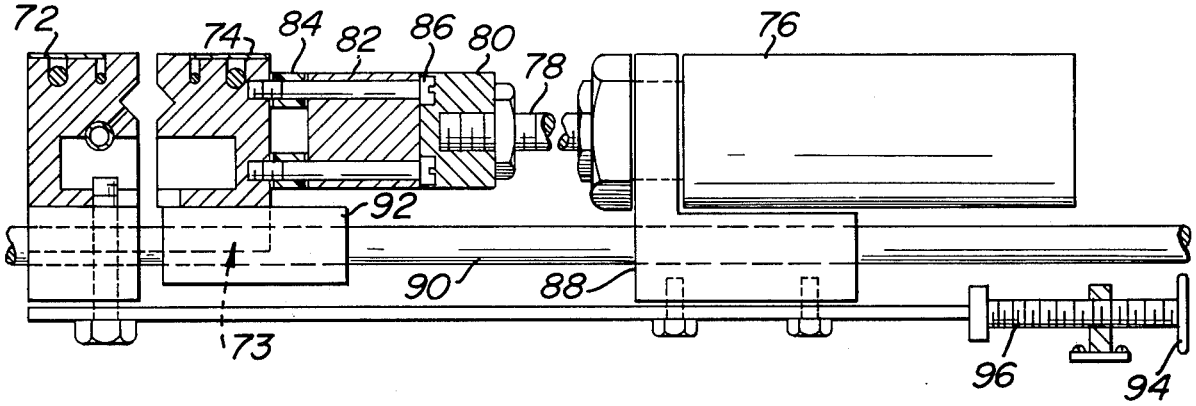
FIG. 8 is a sectional view taken along the line 8—8 in FIG. 1.

At the creasing unit 71, creasing bar 72 is stationary and creasing bar 74 is movable with respect thereto. A cylinder 76 has a piston rod 78 extending therefrom. Piston rod 78 is connected to a pressing member 80 which in turn is connected to a bar member 82. See FIGS. 1 and 8. Bar member 82 is bolted to the creasing bar 74 by bolts 86. In order to prevent conduction of heat from the creasing bar 74 to the air cylinder 76, a layer of insulation 84 is disposed between creasing bar 74 and member 82.

The air cylinder 76 is provided with a support 88. The creasing bar 74 is provided with a support 92. Supports 88 and 92 are telescopically mounted on rod 90.

The creasing bar 72 is supported by the rod 90. A threaded member 96 is provided with a hand wheel 94 at one end and its other end is connected to the creasing bar 72. An intermediate portion of the member 96 which is unthreaded is bolted to the support 88. Hence, rotation of hand wheel 90 moves air cylinder 76, as well as the creasing bars 72, 74 toward and away from the creasing unit 13. The threads on member 96 at the opposite side of the frame have reverse threads whereby the creasing unit 73 simultaneously moves toward and away from the creasing unit 13. Thus, either hand wheel 94 or hand wheel 94′ can be utilized to simultaneously move the creasing units 71, 73 toward and away from the creasing unit 13.

Figure 7:
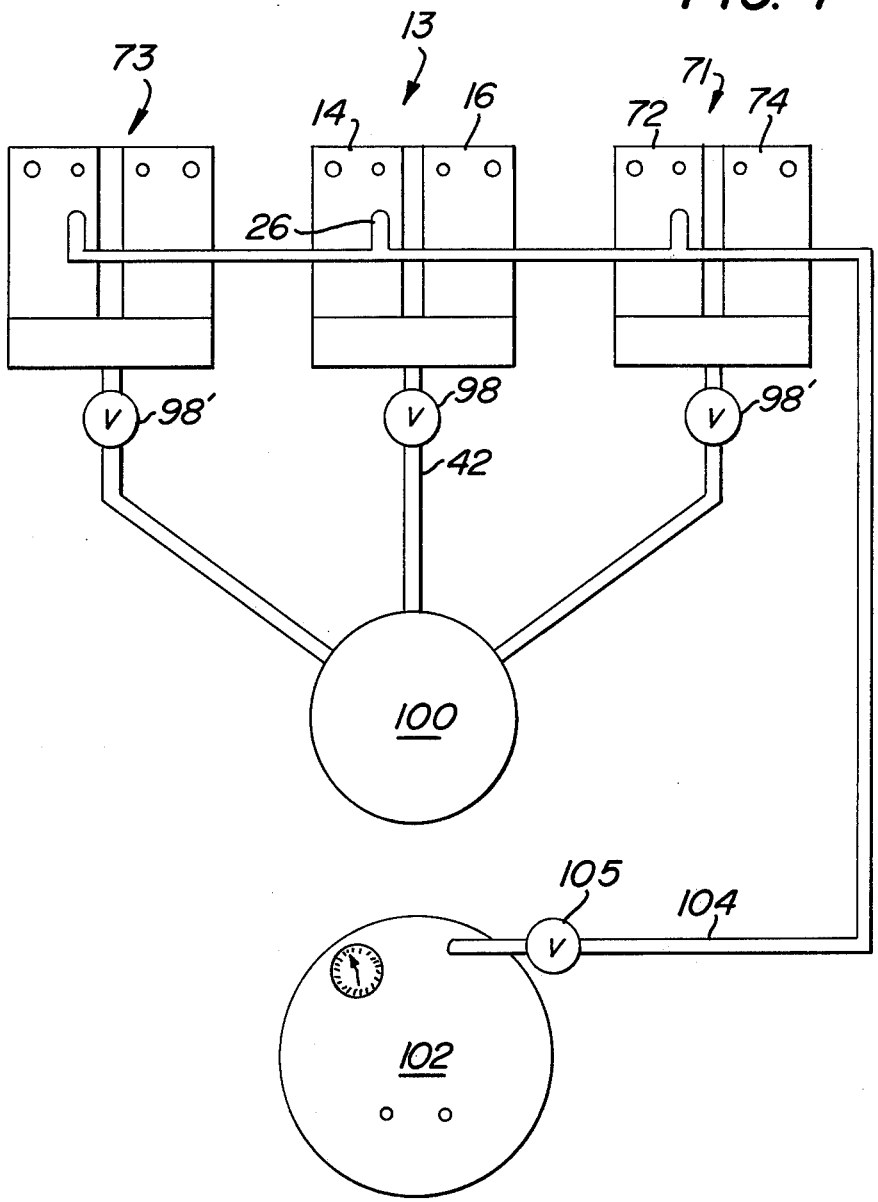
FIG. 7 is a schematic view showing the pressing bars in end elevation.

Referring to FIG. 7, it will be noted that conduit 42 extends from the vacuum chamber 40 to a vacuum tank 100 and contains a selectively operable valve 98. Each of the creasing units 71, 73 is likewise coupled to the tank 100. Conduit 104 containing valve 105 extends from a steam tank 102 to the conduit 26 associated with each of the creasing units 13, 71, 73.

Figure 9:
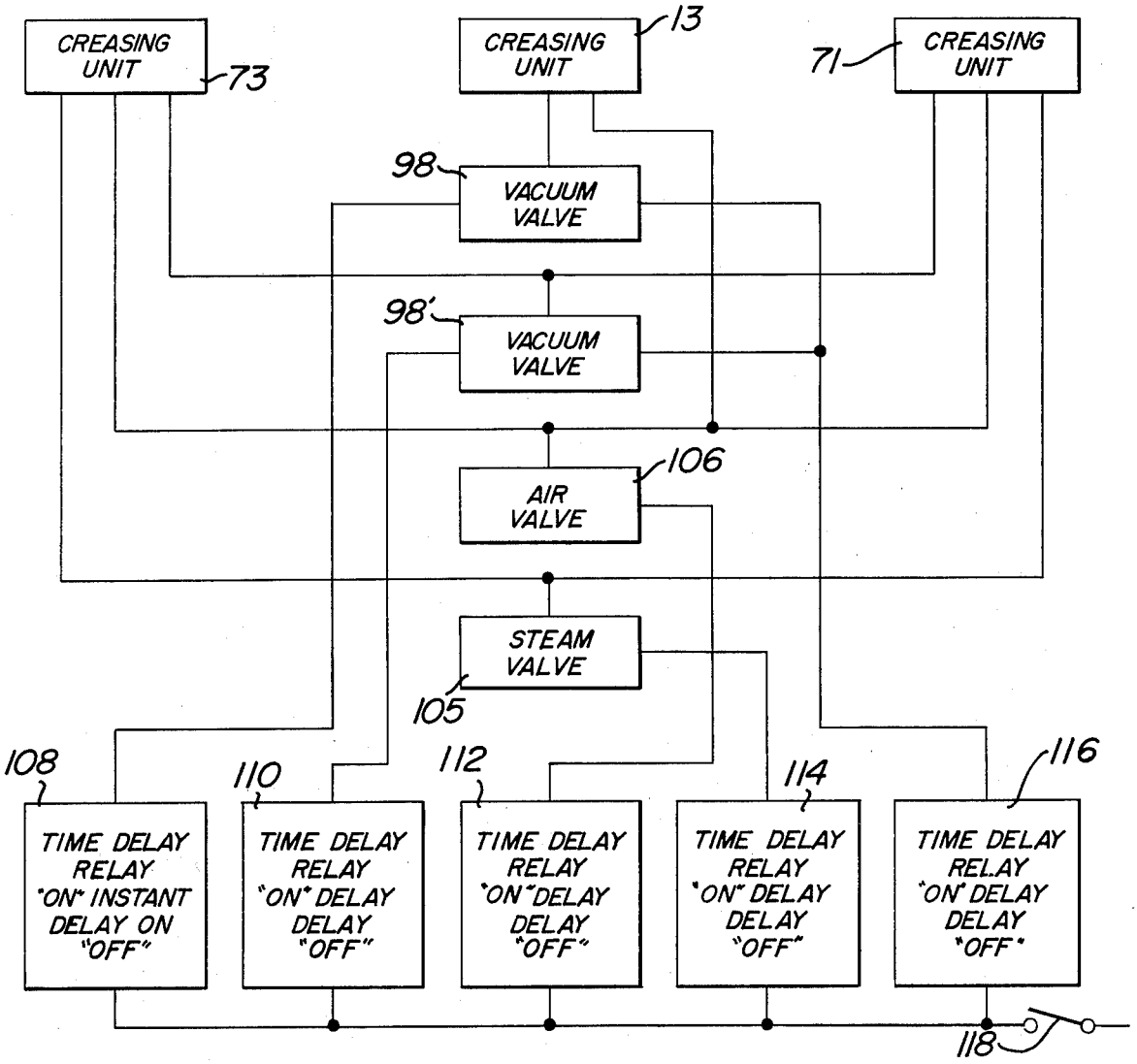
FIG. 9 is a schematic illustration of the circuitry for sequentially operating the pressing machine of the present invention.

Referring to FIG. 9, vacuum valve 98 controls the vacuum transmitted to the creasing unit 13 while vacuum valve 98′ controls the application of vacuum to the creasing units 71, 73. An air valve 106 controls the air or other motive fluid for operating the cylinders 62, 76 and 76′. The valves 98, 98′, 106 and the steam valve 105 are controlled in a sequential manner by the relays 108–116 inclusive. The relays 108–116 are commercially available timer relays. For example, relay 108 may be a Model 43 Struders Dunn monitor timer while the remaining relays may be a Model 44 Struders Dunn repeat cycle timer.

The machine 10 operates as follows. It will be assumed that the machine 10 has been adjusted to the desired spacing between the creasing units 13, 71, 73. Also, it will be assumed that each creasing unit has been adjusted to an open position. A layer of fabric 120 is placed so that it overlies the creasing units as shown in FIG. 3.

Figure 4:
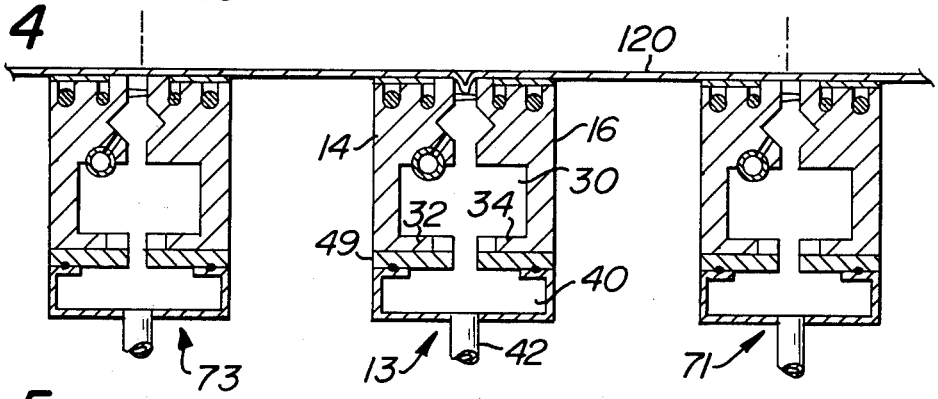

The operator will then push a button or switch, such as reset switch 118, which energives the relays 108–116 inclusive. Relay 108 energizes valve 98 so that a crease is sucked downwardly into the gap between the creaser bars 14–16 and terminates at the level of the pins 20. See FIG. 4. Relay 108 will de-energize the valve 98 after approximately a 3 second delay. After a short interval such as a second, relay 110 will activate valve 98′ to apply vacuum to each of the creasing units 71 and 73. The relay 110 will de-activate the valve 98′ after a delay of approximately 2 seconds from the activation of valve 98′. This will cause a crease to be sucked down into the gap of the creasing units 71, 73 in the same manner as described above. See FIG. 5.

After a short interval of time such as 3 seconds, to allow for full penetration of the creases into the units 71, 73, relay 112 is activated. Relay 112 energizes the air valve 106 whereby each of the creasing units 13, 71 and 73 moves from an open position to a closed position. The creasing bars of each creasing unit apply heat and pressure to the crease disposed therebetween. Relay 112 has an adjustable time cycle, which is preferably set for approximately 12 seconds during which time the fabric 120 will be subjected to clamping pressure and a temperature in the range of 330° F to 350° F with the preferred temperature being 340° F. See FIG. 6.

After the creases have been subjected to heat and clamping pressure as shown in FIG. 6 for a short period of time such as 4 seconds after the initiation of a cycle, relay 114 will activate the steam valve 105 so that superheated steam at a temperature of about 420° F will be discharged upwardly toward the crease by way of the holes 28 at each of the creasing units. Relay 114 will time out after about three or four seconds.

Relay 116 is timed so that it does not become activated until after about 15 seconds from the beginning or initiation of the cycle. When activated, relay 116 energizes the solenoid for the vacuum valves 98, 98' whereby vacuum is again applied to the creases to thereby cool the fabric. The cooling takes approximately 4 seconds, after which relay 116 shuts off and thereby closes valves 98, 98'. Relay 112 times out at approximately the time relay 116 activates and causes the cylinders 62, 76 and 76' to move each of the creasing bars in each of the creasing units to an open position. The fabric 120 may now be removed and will have three parallel or slightly skewed creases depending upon the parallelism of the creasing units.

Rotation of either hand wheel 94 or 94' facilitates simultaneous adjustment of the creasing units 71, 73 with respect to the creasing unit 13. In each of the creasing units, it will be noted that the creasing bars move toward and away from each other simultaneously while moving through the same exact distance at the same speed so that the crease can be applied accurately. Each of the cylinders 62, 76, 76' is located in an area for ease of adjustment in maintenance. While the above description relates to three creasing units, it will be apparent that the machine of the present invention has utility in connection with the application of one or more creasing units. As will be apparent from the above description, only the immediate area of a crease such as ⅛ inch will be subjected to heat, pressure and steam when providing a permanent crease in the fabric 120. Suitable support plates for supporting the fabric intermediate the creasing units may be provided wherever desired.

Each of the creases is preferably only subjected to steam for a short period of time such as 2 to 4 seconds. If the creases are subjected to steam for a greater length of time, they will become excessively wet. When the fabric 120 is 50% polyester and 50% cotton, 8-ounce Durable Press by J. P. Stevens Mills, a steam exposure time of 2½ seconds has been found to be optimum. As will be apparent from the description, only one of the creasing bars is provided with a steam conduit 26 at each of the creasing units. The upper walls of each of the steam chambers 24 are angled upwardly so that the steam is directed at the apex of the crease.

The present invention may be embodied in other specific forms without departing from the spirit or essential attributes thereof and, accordingly, reference should be made to the appended claims, rather than to the foregoing specification as indicating the scope of invention.

I claim:

1. A fabric creasing machine comprising a first set of creasing bars with at least one of said bars being supported for relative movement in a horizontal direction between open and closed positions so as to produce a gap therebetween in the open position, means connected to at least said one bar for moving said one bar between an open and closed position, vacuum means associated with said bars for causing a limited portion of a fabric above the bars to enter such gap when the bars are in an open position, means connected to said bars for heating the bars, and means for subjecting the apex of the crease to superheated steam while the creasing bars are in a closed position applying heat and pressure only to the limited portion of the fabric between the creasing bars without applying heat or pressure to the remainder of the fabric immediately adjacent said limited portion of the fabric.

2. A machine in accordance with claim 1 including a second set of creasing bars generally parallel to and alongside said first set of creasing bars, said means for moving the creasing bars being connected to at least one creasing bar of each set for simultaneous operation between open and closed positions.

3. A machine in accordance with claim 1 including a steam chamber defined by juxtaposed surfaces on said creasing bars immediately below and communicating with the gap when the creasing bars are in their open position, and said means for subjecting a crease to superheated steam being arranged to introduce such steam into said chamber in a direction toward a crease when the creasing bars are in a closed position.

4. A machine in accordance with claim 1 wherein said means for moving the creasing bars includes a power cylinder coupled to each of the creasing bars for simultaneously moving the creasing bars toward and away from each other.

5. A machine in accordance with claim 1 including a plurality of time delay relay timers for sequentially controlling opening and closing of the creasing bars as well as the activation of the vacuum means and the means for subjecting a crease to super-heated steam.

6. A fabric creasing machine comprising a plurality of generally parallel sets of creasing bars, at least one creasing bar of each set being supported for relative movement with respect to its other bar in a horizontal direction between an open and closed position so as to produce a gap therebetween in the open position of the bars, means coupled to at least one creasing bar of each set for simultaneously moving the creasing bars between open and closed positions, vacuum means associated with each set of creasing bars for selectively causing a limited portion of a layer of fabric to be sucked into each gap when the creasing bars are in an open position, means associated with at least one creasing bar of each set for limiting the depth of penetration of the limited portion of fabric into each gap, and steam distribution means for simultaneously subjecting the apex of a crease between the creasing bars of each set to superheated steam while the crease is subjected to heat and clamping pressure by the creasing bars, and means associated with each set of creasing bars to heat the same.

7. A machine in accordance with claim 6 wherein said means for heating the creasing bars includes electrical heaters for heating the creasing bars to a temperature of approximately 330°–350°F.

8. A machine in accordance with claim 6 wherein said vacuum means is arranged to apply vacuum to one of said sets of creasing bars prior to application of vacuum to the other set of creasing bars.

9. A machine in accordance with claim 6 including a plurality of relay timers for sequentially controlling the opening and closing movement of said creasing bars, the application of vacuum to the gap between adjacent creasing bars, and the application of steam to each crease.

10. A fabric creasing machine comprising a set of creasing bars horizontally disposed alongside one another, means for electrically heating each creasing bar, means connected to at least one creasing bar for moving said one creasing bar relative to the other creasing bar between an open position and a closed position, juxtaposed surfaces of said creasing bars defining a steam chamber therebetween, means associated with one of said creasing bars for introducing steam into said steam chamber in a direction upwardly toward a gap between the creasing bars, means for applyinga vacuum to said gap through said steam chamber, and means for preventing a crease of fabric from moving from the gap downwardly into the steam chamber, and means associated with at least said one creasing bar for guiding said one creasing bar horizontally, and each creasing bar having a vertically disposed pressing surface juxtaposed to a comparable pressing surface on the other creasing bar immediately above the steam chamber.

* * * * *